US005370784A

United States Patent [19]

Kammel et al.

[11] Patent Number: 5,370,784

[45] Date of Patent: Dec. 6, 1994

[54] ELECTROLYTIC PROCESS FOR THE PRODUCTION OF FINE-GRAINED, SINGLE-PHASE METALLIC ALLOY POWDERS

[75] Inventors: Roland Kammel; Gunther Schulz; Andreas Specht; Christian Keidel; Uwe Landau, all of Berlin, Germany

[73] Assignee: Schott Glaswerke, Mainz, Germany

[21] Appl. No.: 81,057

[22] Filed: Jun. 25, 1993

[30] Foreign Application Priority Data

Jun. 25, 1992 [DE] Germany ..... 4220849

[51] Int. Cl.[5] ..... C25D 1/20

[52] U.S. Cl. ..... 205/74; 205/81; 205/146; 205/148

[58] Field of Search ..... 205/74, 81, 111, 146, 205/148

[56] References Cited

U.S. PATENT DOCUMENTS 4,507,182 3/1985 Palvadeau et al. ..... 205/74
4,676,877 6/1987 Castillo et al. ..... 205/74

FOREIGN PATENT DOCUMENTS 1305562 2/1973 United Kingdom .
2152533 5/1984 United Kingdom .
243794 9/1966 U.S.S.R. .

OTHER PUBLICATIONS

Chemical Abstracts, 23458n, vol. 82, 1975 (no month) (Bogaez).
CA115(14):144899r, Bull. Electrochem, 7(2), 78–80, (no month) 1991.
CA96(12):93969t, Elektrokhimiya, 18(1), pp. 93–97, (no month) 1982.
Kuhn et al., "Electrodeposition of Silver Alloy Powders on Rotating and Vibrating Cathodes", Trans. of the Inst. of Metal Finish., vol. 6, 1983 (no month).

*Primary Examiner*—John Niebling
*Assistant Examiner*—Edna Wong
*Attorney, Agent, or Firm*—Millen, White, Zelano & Branigan

[57] ABSTRACT

A process for electrolytic production of fine-grained, single-phase, metallic alloy powders, especially powders of intermetallic compounds as well as noble metal alloy powders, is described in which powdery metallic precipitates are galvanically produced on the cathode from an electrolytic precipitating bath known in the art, which contains in solution the metals to be precipitated, under electrolysis conditions causing a powder precipitation known in the art. For the production of alloy powders with defined properties, it is determined, first in preliminary tests by gradual increase of the cathode potential with otherwise constant process parameters, the minimum cathode potential at which single-phase alloy powders result and then the powder precipitation is potentiostatically performed in a cathode potential at or above the minimum for the single-phase alloy precipitation.

25 Claims, 3 Drawing Sheets

ELECTROLYTIC PROCESS FOR THE PRODUCTION OF FINE-GRAINED, SINGLE-PHASE METALLIC ALLOY POWDERS

This invention relates to an electrolytic process for the preparation of fine-grained, single-phase metallic alloy powders, especially powders of intermetallic compounds as well as noble metal alloy powders, in which metallic powders are electrolytically formed on the cathode from an inorganic electrolytic bath.

BACKGROUND OF THE INVENTION

Metal powders have gained great importance with the advances of powder metallurgy. The production processes include, for example: grinding brittle metals or alloys, spraying of melts, the reduction of powdery oxides, thermal decomposition or precipitation of organometallic compounds, and chemical and electrolytic deposition. The various processes produce powders with very different properties. In this connection, besides the properties of the material, the morphological powder properties (particle shape, particle size distribution) play a large role in the processing steps of powder preparation, shaping and consolidation. Thus, the latter also have a great influence on the residual porosity and the surface composition as well as on the structure of the final product.

Electrolytically produced powders are often comprised of dendritically grown crystals. Powders formed on stationary electrodes show, depending on electrolysis conditions, particle sizes between 300 and 1 $\mu$m.

The powdery precipitate on the cathode is formed in the electrolytic process under conditions which are opposite to those of electrolytic plate formation. As a rule, the precipitates crystallize in a powdery manner at high current densities, low metal ion concentrations and low bath temperatures. To intensify the transport of material, oscillating or rotating electrodes are used which simultaneously foster the detachment of the powder deposited on the electrode. The powdery precipitate detached or to be brushed off from the electrode is collected either at the bottom of electrolytic cells or in an organic medium underneath the electrolyte (two-phase bath).

In recent years, noble metal alloy powders have also received attention because of their advantageous physical-chemical properties. Thus, for example, silver-palladium alloy powders were developed for dental prosthetic applications. Other possibilities of use can be foreseen in the field of electronics and in the chemical industry.

A process for electrolytic production of pourable powders from noble metals, especially from platinum, palladium or gold, is known, for example, from DD-PS 139 605. According to the publication, powders of defined particle size are said to be producible by electrolytic methods if the precipitation is performed with solutions of platinum metal hydrochloric acids and gold hydrochloric acids in the diffusion limiting current range, i.e., in the range between solid precipitation and hydrogen formation. In particular, the particle size in the previously described process is said to be able to be influenced by a variation of the concentration, the temperature and the pH.

But even though the electrolytic precipitation of pourable powders made of noble metals, preferably platinum, palladium, rhodium, gold and their alloys, is indicated in the patent specification as a field of use of the invention, the disclosed technical teaching exclusively relates to the precipitation of pure metals. No reference is made to the electrolytic precipitation of alloyed metallic powders.

However, a process for electrolytic production of alloyed AgPd powders is described in the article "Electrolytic Preparation of Fine PdAg Powders of Any Given Composition," M. I. Kalinin Leningrad Engineering Institute, translated from Poroshkovaya Metallurgiya, No. 6 (126), pp. 6–10, June 1973.

The authors report on systematic studies on the influence of the electrolysis parameters of bath composition, bath temperature and current density in the powder precipitation range in the chemical and crystallographic composition as well as the particle size and morphology of the precipitated powder and indicate value ranges for the electrolysis parameters as a result of their studies for the AgPd system, within which a precipitation of true alloy powders with predetermined composition is said to be possible.

A drawback of this known process is that the indicated, empirically determined ranges of values for the electrolysis parameters are very narrow and relate exclusively to the AgPd system as well as to a specific electrolytic bath. A transfer of the obtained results to other electrolytic baths or other alloying systems is not possible.

SUMMARY OF THE INVENTION

An object of the invention is to develop a process for the production of single-phase alloy powders by an electrolytic method for almost any system.

Upon further study of the specification and appended claims, further objects and advantages of this invention will become apparent to those skilled in the art.

These objects are achieved by a process in which powdery metallic precipitates are electrolytically formed on the cathode from an inorganic electrolytic bath known in the art, which contains in solution the alloy components to be precipitated, under electrolysis conditions causing a powder precipitation known in the art. A characterizing feature of the invention is to conduct preliminary tests by a gradual increase of the cathode potential under otherwise constant process parameters, to determine the cathode potential at which single-phase alloy powders results and then the performing of the powder precipitation potentiostatically at a cathode potential at or above the determined critical potential for single-phase alloy powder precipitation.

The inventors have discovered, surprisingly, that the cathode potential alone is the driving force for the alloy powder formation. Single-phase alloy powders result only above a critical cathode potential dependent on the alloy composition. Below the critical electrode potential, generally only multiphase, i.e., heterogeneous alloy powders, result. At even lower electrode potential, only mixtures of the individual metals result.

DETAILED DESCRIPTION OF THE INVENTION

According to the process of the invention, it is therefore first determined, in preliminary tests by successively increasing the cathode potential, for example, under otherwise constant electrolysis conditions, the cathode potential at which single-phase alloy powders result. The powder precipitation is then performed potentiostatically with a cathode potential at or above the determined critical potential for single-phase alloy powder formation. The otherwise constant electrolysis conditions during the preliminary determination are, optionally determined in other preliminary tests with respect to a performance of the process that is as simple and economical as possible. These conditions include, e.g., bath composition, bath temperature, nature of the cathode and flow conditions in the boundary area in front of the cathode.

The potentiostatic mode of operation in this case is of special importance. Not only metal powders with defined chemical and crystallographic composition, but also with very narrow particle size distribution and defined morphology can thus be produced.

The known processes are usually performed at constant current density. But in the metal powder electrolysis, the electrochemically effective cathode surface is subjected to considerable changes over time by the growth and separation of the metal powder. In this case, if the flow of current forced on the system from outside remains constant, constantly changing work potentials occur on the cathode due to the changing surface. This results in completely different properties of the precipitated precipitate, e.g., its morphology, particle size and especially its chemical and crystallographic composition. Metal powders, whose properties vary uncontrolled in wide limits, are the result. Only the potentiostatic mode of operation proposed in this invention guarantees, on the other hand, metal powders with defined properties.

A further advantageous development of the invention provides for developing a phase diagram for an advantageous alloying system by an electrolytic method. In such a diagram the discovered phases are plotted (with different symbols for different crystallographic structures) by the metal ion concentration ratio in the electrolyte as a function of the cathode potential.

For this purpose, metallic powders are precipitated under electrolysis conditions, otherwise kept constant, for different metal ion concentration ratios of the alloy components at a given total metal ion concentration and different cathode potentials and are tested by suitable chemical and structure-analytical processes, for example, by x-ray structure analysis, for their chemical and crystallographic composition.

The number of measuring points for the phase diagram and their distribution over the concentration and potential range should in this case be matched to one another so that, with as few measuring points as possible, the areas of the individual phases can be clearly distinguished from one another. The phase diagram can extend over the entire composition range of the alloying system or only over a comparably narrow, advantageous concentration range.

The above-described approach has the advantage that with repeated precipitation of alloy powders of the same alloying system, but with different compositions, the cathode potential at or above which a single-phase alloy formation occurs does not have to be determined for every individual alloy composition in each case in expensive tests. The critical cathode potential belonging to any alloy composition can De determined in a simple way from the phase diagram constructed for the alloying system.

It has been shown in the tested alloying systems that pure individual metal, mixed crystal or intermetallic phases can occur individually or side by side. Besides the phases stable in thermodynamic equilibrium in the case of the electrolysis temperature, metastable intermetallic phases and supersaturated mixed crystals can also occur. The level of the cathode potential, which is necessary to precipitate single-phase alloy powders, is dependent on the alloying system. If the system tends toward the formation of intermetallic phases, often low potentials for the production of single-phase powders are sufficient. However, if the system shows a tendency toward separation (miscibility gap), high potentials are necessary. Also, it is possible that individual thermodynamically stable phases will not occur electrolytically.

The process according to the invention can be performed both continuously and discontinuously. The latter means that at regular intervals, the process is interrupted and the metallic precipitate is removed mechanically from the cathode, for example by brushing off or wiping off.

Under a mode of operation suitable for automation, however, continuous processes have increasingly gained acceptance in recent years in electrolytic powder production. Continuous processes involve means for automatically and continuously removing the powder that is formed on the cathode. Further, the regular removal of the powdery precipitate provides a powder with sharply defined properties.

The adhesion of the powder to the electrode is dependent on: 1) the physical-chemical properties of the precipitated powder, 2) the electrolyte, 3) the electrolysis conditions—because of the influence of the crystallization of the powder shape of the crystal, size of the crystal) —4) the surface properties of the electrode material (material, roughness, coating with impurities and additives) and 5) external intervention, such as oscillating, rotating or sudden electrode movements, rising gas bubbles, use of ultrasound and mechanical brushing off. The powder detachment behavior thus takes place influenced by a plurality of factors mutually linked in the interplay of the binding and detaching forces.

In a preferred embodiment of the invention, laminar and/or turbulent flows in the area of the boundary layer in front of the cathode are produced during the precipitation process in such a strength that the powder particles precipitated on the cathode are continuously detached. Besides providing for continuous detachment of the powder, this embodiment also has the advantage that the material transport and thus the productivity of the process is increased by the relative movement between electrolyte and cathode.

The relative movement between electrolyte and cathode is preferably produced by oscillating the cathode in a way known in the art during the precipitation process. The powder detachment behavior is variable depending upon the frequency and amplitude of the electrode oscillations. Frequencies between 5 Hz and 10 kHz, especially between 10 and 100 Hz, are preferred. The amplitude of oscillation should lie between 0.1 and 200 mm, and the upper limit is determined as a matter of technical/economic feasibility. Particularly preferred are amplitudes of oscillation between 1 and 100 mm.

The relative movement between cathode and electrolyte can also be used advantageously to influence the particle size distribution of the precipitated powder. With the use of an oscillating electrode as a cathode, an increase of the amplitude of oscillation generally results in an enlargement of the particle size and optionally also in a widening of the particle size distribution curve. But this mode of action can still be greatly dependent on the frequency of the oscillation. Usually very fine powders, with a narrow distribution curve are obtained on a resting cathode.

The application of ultrasound in the case of an oscillating electrode does not lead to any significant change of the particle size, but in the resting electrode, a shifting of the particle size distribution curve to smaller values and a further narrowing of the distribution curve are observed.

In the process according to the invention, preferably, the following properties of the alloy powders can be specifically adjusted: chemical and crystallographic composition, particle size distribution, particle shape and purity of the powder.

As process parameters for obtaining the above-mentioned powder properties, the following are of primary importance: cathode potential, bath composition, especially metal ion concentration ratio of the alloy components and total metal ion concentration, flow conditions in the area of the boundary layer in front of the cathode—i.e., when using an oscillating electrode system: frequency and amplitude of the oscillating electrode—further, bath temperature and material and surface condition of the cathode.

In principle, all these process parameters together influence the powder properties, and it is hardly possible to change selectively only one property by changing a process parameter. But generally there are more or less large ranges for all process parameters within which a desired powder property occurs, so that a "coordination" of the process parameters to achieve a desired powder quality is easily possible. This can take place, for example, with a few routine experiments.

In addition to the chemical and crystallographic composition, the cathode potential also influences other powder properties. It especially affects the particle size distribution of the powder, and a close connection with the powder detachment behavior exists. In the description of these dependencies, in principle, the differentiation between two ranges is necessary. Below the cathodic decomposition (e.g., hydrogen (co-) precipitation) of the solvent, an increase in potential with otherwise constant process parameters produces a reduction of the particle size, while the detaching of the powder passes through a maximum and finally can be brought completely to a standstill. Also, with a further increase of the cathode potential, the particle size of the powder generally further decreases, but a stirring action resulting in a countering action of increasing the particle size can occur by the cathodically produced gases. A strong gas generation, however, can also produce a renewed detachment of the powder from the cathode, thus, decreasing particle sizes. Upwardly, the cathode potential is basically limited by economic aspects, e.g., the current efficiency declines with increasing cathode potential. Alternatively, the determination of their values can be conducted by starting the preliminary tests at very high potentials, thereby producing single phase alloy powder precipitation and lowering the potential to determine the desirable and/or critical potential.

The process according to the invention can be performed with the usual electrolytic precipitating baths. Absolutely necessary bath components are: a solvent, salts of the metals to be precipitated and at least one acid or alkaline solution. In a preferred embodiment, the metals are present in the electrolyte in the form of organic or inorganic compounds of the same kind, for example, in the form of inorganic salts, especially in the form of very simple noncomplexing nitrates or chlorides. This has the advantage that the diffusion of the metal ions in the cathodic phase boundary layer and not the decomplexing of the metal ions determines the rate of precipitation. As a result, higher rates of precipitation and a facilitated powder formation occur.

The chemical composition of the precipitated powder is basically determined by the metal ion concentration ratio of the alloy components in the electrolyte. However, the total metal ion concentration has an effect, mainly on the particle size, but also on the productivity of the process. It holds true: the lower the metal ion concentration, the lower the particle size, but also the lower the current efficiency. The upper limit is given by reaching the solubility product. Further, both the metal ion concentration ratio and the total metal ion concentration exert influence on the powder detachment behavior.

The pH of the precipitating bath is to be selected dependent on the system, and care must be taken that a pH-dependent triggered precipitation of the metal ions in the electrolyte does not occur even in the area of the boundary layer in front of the cathode. Greatly contaminated powders, e.g., by oxygen, are otherwise to be expected. Further, the pH should be adjusted so that attack of the precipitated powder is substantially nonexistent, i.e., the acid concentration should not be too high.

Advantageously, one or more inorganic and/or organic additives are added to the precipitating bath to influence the particle size and particle shape. The additives can improve, for example, the conductivity of the bath (optionally higher productivity, coarser powders), form complexes with one or all metal ions involved in the precipitation, so that the respective free metal ion concentration drops or the precipitation from the complex takes place with a changed precipitation mechanism (change of the particle size and morphology) or affect electrocrystallization of the metals on the cathode (also change of particle size and morphology). Preferred are total concentrations of additives between 1 mg/l and 200 g/l. With concentrations below 1 mg/l, the measurable effectiveness of the additive drops off too greatly. The upper limit is given by the maximum solubility of an additive.

With pure organic additives, concentrations of $<1$ g/l are preferred, since their maximum effectiveness is achieved at this concentration.

Pure inorganic additives show an only slight effectiveness in concentrations $<10$ g/l. Therefore, higher concentrations of such additives are preferred.

Preferred organic additives are proteins and/or protein decomposition products, especially gelatin, agar-agar and/or surfactants, especially sodium lauryl sulfate.

Preferred inorganic additives are sulfates, chlorides and/or nitrates of alkali metals, such as, e.g., $Na_2SO_4$, $Li_2SO_4$ and/or, if soluble, also alkaline-earth metals, e.g., $MgSO_4$.

It was determined that a consumption of the metal ions in the bath of up to 50% (relative to the starting concentration of the metal ions) generally does not result in any significant change of the chemical and crystallographic composition of the alloy powders produced in comparison to the starting alloy composition of the powders. The alloy components are reduced at a constant concentration ratio, if the cathode potential is not too small. But, nevertheless, to prevent a bath depletion, it is advisable to take take usual electrolyte regenerating measures, such as, e.g., subsequent dosing of concentrated metal salt solutions.

The bath temperature has almost no influence on the powder properties, but considerable effects on the current efficiency and thus on the productivity of the process. The current efficiency increases with increasing bath temperature. The bath temperature is limited upward by the physical and chemical tolerance range of the solvent (e.g., water) and of the components and of the finished electrolyte.

The material of the cathode is to be selected so that it is not corroded by the electrolyte and facilitates the separation of the powder. Suitable materials are, e.g., aluminum, titanium, high-grade steel, nickel, gold or graphite. By modifying the cathode surface, for example by introducing oxide layers or applying organic separating layers, such as, e.g., mineral oils or PTFE "teflon", the removal of the powder from the cathode can be fostered. As a result, on the one hand, finer powders are obtained (reduction of the average retention time), on the other hand, the property spectrum of the powder can become narrower (evening out the retention time spectrum). A change of the powder morphology is only achievable if the morphology changes with the retention time on the electrode. The modification of the cathode surface itself takes place in process steps, which occur before the actual electrolysis.

The peak-to-valley undulations of the cathode surface should be at most several mm, preferably only several μm to assure that a high powder yield, a uniform powder separation behavior and thus also constant powder properties are achieved.

The shape of the cathode should be constituted so that as uniform as possible a flow and potential distribution on the cathode surface is provided. With use of an oscillating electrode as cathode, the latter is preferably to be designed as a vertically placed cylinder, which is put into oscillations in the vertical direction.

Any conventionally known counterelectrode and reference electrode can be used for the process.

The process according to the invention can be used in principle for any alloying systems, for example, for alloys of the transition metals and tin alloys. But alloys of nobel metals Pt, Ru, Rh, Pd, Os, Ir, Ag, Au preferably are to be produced with the process according to the invention.

The process according to the invention has the particular advantage that for the first time, specifically single-phase powders can be electrolytically produced for almost any alloying system. In this connection, not only are powders with sharply defined properties, such as chemical and crystallographic composition, particle size and morphology, obtained, but, the precipitated powders because of the refining effect accompanying the electrolytic precipitation are also further distinguished by a high purity which cannot be achieved with the usual processes.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosures of all applications, patents and publications, cited above and below, and of corresponding application German P 42 20 849.1, filed Jun. 25, 1992, are hereby incorporated by reference.

EXAMPLES

Figure 1:
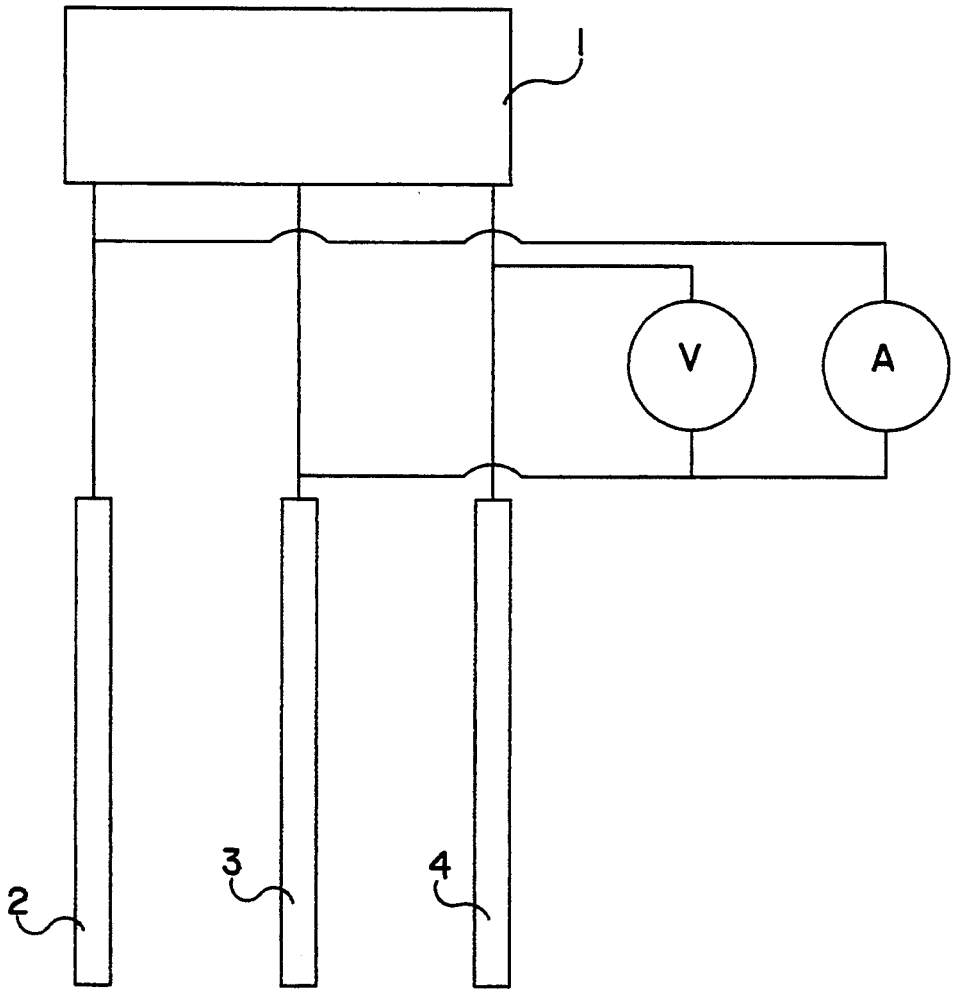
FIG. 1: The electrode arrangement for a three-electrode method known in the art.

Powder precipitations were conducted according to the three-electrode method, known in the art, for electrochemical measurements. The electrode arrangement used in this method is represented in FIG. 1. In FIG. 1, the potentiostat is designated by (1), the counterelectrode by (2), the working electrode by (3) and the reference electrode by (4). V and A designate a voltmeter and an ammeter, respectively.

The core part of the unit was an oscillating electrode, which was connected with a potentiostat/galvanostat (model PAR 273, Princeton Applied Research company) and a desk computer (model 216, Hewlett Packard). The control of the precipitation process took place partially computer-aided.

The oscillating electrode system used was a sine-wave generator (type TPO-25), whose frequency- and amplitude-changeable signal controlled an electromagnetic oscillator (type 201, Ling Dynamics company), which put the working electrode into oscillations.

The amplitude of the oscillating electrode was dependent on the frequency and achieved an oscillating amplitude of 1.8 mm for coupled maximum values, at a frequency of 50 Hz.

A wide-mouthed glass vessel of 600 ml capacity was used as the electrolysis cell. The oscillating electrode was placed centered in the electrolysis cell. As counterelectrode, an insoluble anode of platinized titanium-expanded metal was used. As reference electrode, a saturated calomel electrode (SCE, standard potential $E^{\circ} = +0.245$ V) was used.

In the following embodiments, in the case of the powder precipitation, with otherwise respectively constant electrolysis conditions, the cathode potential as well as the concentrations of the alloy components with constant total metal ion concentration were varied. The precipitated powders were then examined by methods known in the art for their chemical composition and crystallographic structure.

AgPd System

Figure 2:
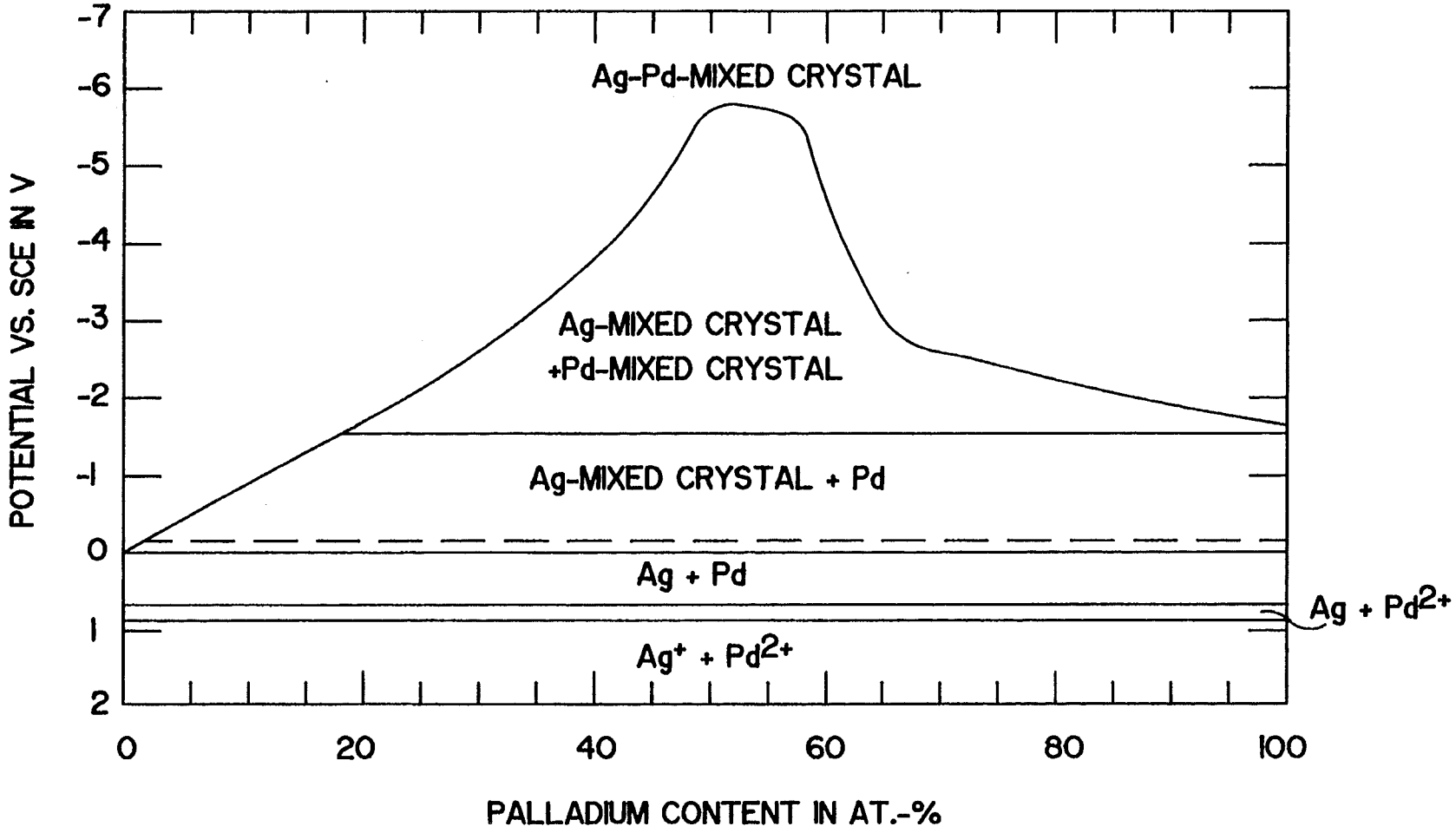
FIG. 2: A phase diagram made for the AgPd system according to the process of the invention.

The results for the AgPd system are listed in tables 1 to 3 and are graphically represented in FIG. 2 in the form of a phase diagram. In the tables and in the figure, MK in each case designates mixed crystal formation. $E_{Ag}$ or $E_{Pd}$ are the reversible reduction potentials of silver and palladium, respectively.

The following constant process parameters were set:

Total metal ion concentration ($m_{Ag}+m_{Pd}$): 1 g/l
$HNO_3$ concentration: 6 g/l
solvent: distilled water
cathode: graphite; cylindrical 10 mm×10 mm diameter
oscillation conditions: amplitude=2 mm; frequency=35 Hz
counterelectrode: titanium-expanded metal
temperature: 20° C.

In each case, the metal ion concentration ratio of alloy components $C_{Ag/Pd}$ and cathode potential $E_K$ were varied in the following tables 1 to 3.

TABLE 1

$c_{Ag}$ = 0.65 g/l; $c_{Pd}$ = 0.35 g/l

| $E_K$ vs. SCE in V | Number of phases in the powder | Type of phase(s) | Chem. Analysis of powder (total) |
|---|---|---|---|
| +0.750 | 1 | Ag | 100% Ag |
| +0.100 | 2 | pure Ag, pure Pd | 90% Ag, 10% Pd |
| −1.000 | 2 | $MKAg_{87}Pd_{13}$ + Pd | 75% Ag, 25% Pd |
| −2.700 | 2 | $MKAg_{60}Pd_{40}$ + $MKAg_{37}Pd_{63}$ | 65% Ag, 35% Pd |
| −3.000 | 1 | $MKAg_{65}Pd_{35}$ | 65% Ag, 35% Pd |
| −5.000 | 1 | $MKAg_{65}Pd_{35}$ | 65% Ag, 35% Pd |

TABLE 2

$c_{Ag}$ = 0.1 g/l; $c_{Pd}$ = 0.9 g/l

| $E_K$ vs. SCE in V | Number of phases in the powder | Type of phase(s) | Chem. Analysis of powder (total) |
|---|---|---|---|
| +0.5 | 2 | pure Ag; pure Pd | 95% Ag, 5% Pd |
| −0.5 | 2 | $MKAg_{93}Pd_7$ + pure Pd | 70% Ag, 30% Pd |
| −1.5 | 2 | $MKAg_{75}Pd_{25}$ + $MKAg_{10}Pd_{90}$ | 11% Ag, 89% Pd |
| −3.0 | 1 | $MKAg_{10}Pd_{90}$ | 10% Ag, 90% Pd |
| −6.0 | 1 | $MKAg_{10}Pd_{90}$ | 10% Ag, 90% Pd |

TABLE 3

$c_{Ag}$ = 0.5 g/l; $c_{Pd}$ = 0.5 g/l

| $E_K$ vs. SCE in V | Number of phases in the powder | Type of phase(s) | Chem. Analysis of powder (total) |
|---|---|---|---|
| +0.5 | 2 | pure Ag; pure Pd | 97% Ag, 3% Pd |
| −2.0 | 2 | $MKAg_{73}Pd_{27}$ + $MKAg_{20}Pd_{80}$ | 63% Ag, 37% Pd |
| −4.0 | 2 | $MKAg_{55}Pd_{45}$ + $MKAg_{37}Pd_{63}$ | 54% Ag, 46% Pd |
| −6.0 | 1 | $MKAg_{50}Pd_{50}$ | 50% Ag, 50% Pd |

It is shown in FIG. 2 that the alloying behavior of the AgPd system can be represented very clearly in a new type of phase diagram. Modeled on usual temperature-concentration phase diagrams, in FIG. 2, the phases that have developed in the powder precipitation as a function of the cathode potential and for simplicity's sake are applied by the Pd concentration in the precipitated powder. A representation with the metal ion concentration ratio as the abscissa could be selected just as well. An advantage of this manner of representation lies not only in the clarity but especially also in the simple readout possibility of the quantitative ratios of the precipitated phases by use of the lever principle known in the art.

But the phase diagram presented here can be considered only as a rough overview because of the relatively small number of measuring points on which it is based. For the exact determination of the phase boundary lines, additional measurements would also have to be made. But the diagram clearly shows the miscibility gap, within which the produced alloy powders heterogeneously crystallize. It can be seen that two heterogeneous phase fields exist here. With small potentials, silver-rich mixed crystals in addition to palladium crystals result. With higher potentials, in addition to the silver-rich, also palladium-rich mixed crystals result, until, with further increasing electrode potential, the miscibility gap disappears and single-phase AgPd alloy powders can be precipitated over the entire concentration range.

Further, it can be seen that the critical potential for single-phase alloy formation depends on the AgPd concentration ratio in the electrolyte or on the alloy composition to be produced. Thus, the critical potential for a single-phase $Ag_{50}Pd_{50}$ alloy powder is still above −5 V (vs. SCE), while a single-phase $Ag_{90}Pd_{10}$ alloy powder may be precipitated at −1 V.

Thus, it can be seen that in the electrolytic powder precipitation, the driving force of the single-phase alloy formation is actually the electrode potential. Only above a critical electrode potential are single-phase alloy powders observed, which by their chemical composition come very close to the Ag-Pd concentration ratios of the electrolyte.

CuSn System

The process according to the invention is also suitable for the production of single-phase powders of intermetallic compounds, as is to be demonstrated below by the CuSn system. Intermetallic compounds are phases with a concentration range so narrow that a specific stoichiometric composition of the components can be indicated.

The following tables 4 to 6 show that also in intermetallic compounds for specific metal ion concentration ratios, cathode potentials can be found, in which a single-phase powder precipitation takes place.

The following process parameters were kept constant:

Base electrolyte: 2 g/l of total metal ion concentration 30 g/l of hydrochloric acid 10 g/l of ammonium chloride
solvent: distilled water
cathode: titanium; cylindrical 10 mm×10 mm diameter
oscillation conditions: amplitude=1 mm; frequency=35 Hz
counterelectrode: titanium-expanded metal
bath temperature: =65° C.

TABLE 4

$E_k$ = −400−−600 mV vs. SCE

| Sn-ion concentration (residue of Cu) in g/l | Number of phases in the powder | Type of phase(s) |
|---|---|---|
| 1.30–1.50 | 2 | α-mixed crystal + δ-bronze |
| 1.55–1.65 | 1 | δ-bronze |
| 1.70–1.80 | 2 | δ- + ξ-bronze |
| 1.85–1.95 | 1 | ξ-bronze |

TABLE 5

$E_k$ = −400−−800 mV vs. SCE

| Sn-ion concentration (residue of Cu) in g/l | Number of phases in the powder | Type of phase(s) |
|---|---|---|
| 0.95–1.25 | 1 | α-mixed crystal |

TABLE 5-continued

| $E_k$ = −400−−800 mV vs. SCE | | |
|---|---|---|
| Sn-ion concentration (residue of Cu) in g/l | Number of phases in the powder | Type of phase(s) |
| <0.05 | 2 | ω-tin + ξ-bronze |

TABLE 6

| $E_k$ = −1000−−2000 mV vs. SCE | | |
|---|---|---|
| Sn-ion concentration (residue of Cu) in g/l | Number of phases in the powder | Type of phase(s) |
| 0.80–1.30 | 2 | α-mixed crystal + η-bronze |
| 1.35–1.45 | 1 | η-bronze |
| 1.50–1.95 | 2 | η-bronze − ω-tin |
| <0.05 | 1 | ω-tin |

Figure 3:
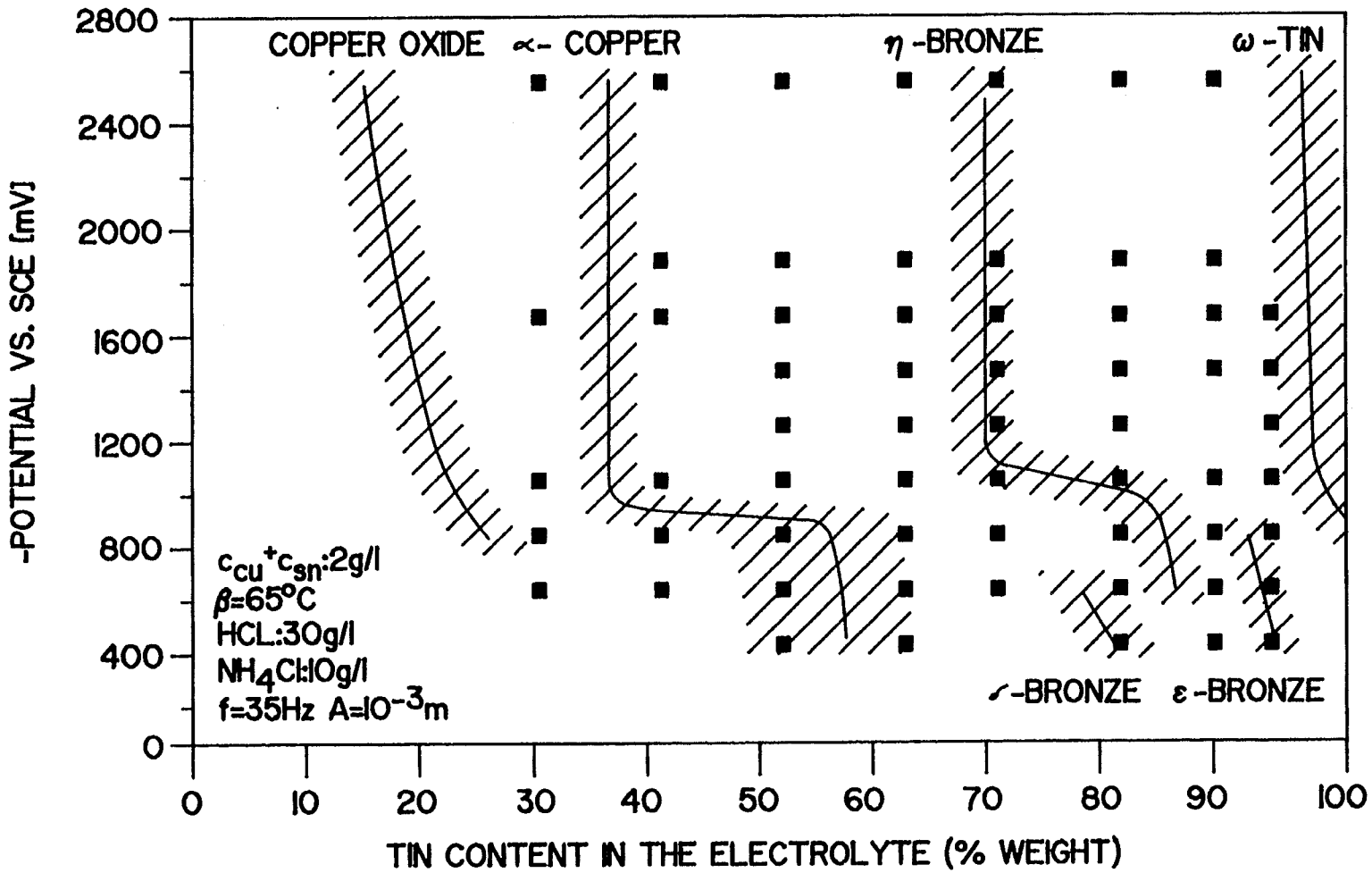
FIG. 3: A phase diagram made for the CuSn system according to the process of the invention.

Even more pronounced than in the case of the AgPd system, the electrolytic phase diagram, sketched based on the above measured values, for the CuSn system in FIG. 3 provides only a very rough survey of the phase stability and the phase limits. But the zones of existence fields of single-phase powders of the intermetallic compounds in the CuSn system can be easily shown.

CuNi System

In a final embodiment, it is shown that single-phase alloy powders can also be produced for the CuNi system with a fixed metal ion concentration ratio and otherwise constant process parameters by increasing the cathode potential:

Base electrolyte: 0.5 g/l of nickel as $NiCl_2$ 0.5 g/l of copper as $CuCl_2$ 5.0 g/l of ammonium chloride cathode: titanium; cylindrical 10 mm×10 mm diameter oscillation conditions: amplitude=1 mm; frequency=35 Hz bath temperature:=65° C.

EXAMPLE 1:

E=−4 V vs. SCE: two-phase, pure nickel phase and copper mixed crystal

EXAMPLE 2:

E=−6 V vs. SCE: single-phase mixed crystal (chem. composition: 55% Cu, 45% Ni)

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

What is claimed is:

1. In a process for the electrolytic production of fine-grained, single-phase, metallic alloy powders, in an electrolytic cell comprising a cathode, a counterelectrode and an electrolytic bath, in which powdery metallic precipitates are electrolytically formed on the cathode from the electrolytic bath, which contains in solution the alloy components to be precipitated, under electrolysis conditions causing a powder precipitation, wherein:

the minimum cathode potential at which single-phase alloy powders result is predetermined for the said alloy components in preliminary tests by successive gradual increase of the cathode potential with otherwise constant process parameters, and then the powder precipitation is potentiostatically performed at a cathode potential at or above said minimum cathode potential for single-phase alloy precipitation.

2. The process of claim 1, further providing sufficient flow in the electrolytic bath in the area of the boundary layer of the cathode to continuously detach the powder particles from the cathode.

3. The process of claim 1, wherein said electrolytic bath has a current efficiency controlled by the flow conditions in the electrolytic bath at the cathode surface.

4. The process of claim 1, wherein precipitated powder has a particle size controlled by the flow conditions in the electrolytic bath at the cathode surface.

5. The process of claim 1, wherein the cathode is oscillated during the precipitation process.

6. The process of claim 5, wherein, to increase the material conversion in the electrolytic bath, ultrasound is applied to the bath or the bath is additionally stirred.

7. The process of claim 1, wherein the metals to be precipitated are added to the electrolytic bath in the form of inorganic salts.

8. The process of claim 1, wherein to influence current efficiency of the electrolytic bath, particle size of the powders, morphology of the powders or any combination thereof, one or more inorganic additives organic additives or mixtures thereof are added to the electrolytic bath, in a total concentration of 1 mg/l–200 g/l, to increase the conductivity of the bath or form complexes with one or all metal ions involved in the precipitation or affect the electrocrystallization of the metals on the cathode or any combination thereof.

9. The process of claim 8, wherein proteins, gelatin, agar-agar, surfactants or any mixtures thereof are used as the organic additives.

10. The process of claim 8, wherein sulfates, chlorides or nitrates of the alkali metals or soluble chlorides or nitrates of the alkaline-earth metals or any mixtures thereof, are used as the inorganic additives.

11. The process of claim 1, wherein the cathode surface is coated with a thin, electrically nonconducting layer, which fosters the powder detachment behavior of the cathode.

12. The process of claim 1, wherein the powders are intermetallic compounds or noble metal alloy powders.

13. A process for the electrolytic production of fine-grained, metallic alloy powders, in an electrolytic cell comprising a cathode, a counterelectrode and an electrolytic bath, in which powdery metallic precipitates are electrolytically formed on the cathode from the electrolytic bath which contains in solution the alloy components to be precipitated, under electrolysis conditions causing a powder precipitation, wherein: a phase diagram, giving areas of resulting phases characterized by the metal ion concentration ratio as a function of the cathode potential, is predetermined for the said alloy components in preliminary tests wherein the cathode potential is successively gradually increased for several metal ion concentration ratios with a constant total metal ion concentration and the obtained powders for each preliminary test are examined and their chemical and crystallographic compositions are obtained and then the powder precipitation is potentiostatically performed at a cathode potential and a metal ion concentration ratio selected from the phase diagram to give the desired chemical and crystallographic compositions.

14. The process of claim 13, further providing sufficient flow in the electrolytic bath in the area of the boundary layer of the cathode to continuously detach the powder particles from the cathode.

15. The process of claim 13, wherein said electrolytic bath has a current efficiency controlled by the flow conditions in the electrolytic bath at the cathode surface.

16. The process of claim 13, wherein precipitated powder has a particle size controlled by the flow conditions in the electrolytic bath at the cathode surface.

17. The process of claim 13, wherein the cathode is oscillated during the precipitation process.

18. The process of claim 17, wherein the frequency of oscillation is between 5 Hz and 10 kHz.

19. The process of claim 17, wherein, to increase the material conversion in the electrolytic precipitating bath, ultrasound is applied to the bath or the bath is additionally stirred.

20. The process of claim 13, wherein the metals to be precipitated are added to the precipitating bath in the form of inorganic salts.

21. The process of claim 20, wherein to influence current efficiency of the electrolytic bath, particle size of the powders, morphology of the powders or any combination thereof, one or more inorganic additives, organic additives or mixtures thereof are added to the electrolytic bath, in a total concentration of 1 mg/l–200 g/l, to increase the conductivity of the bath or form complexes with one or all metal ions involved in the precipitation or affect the electrocrystallization of the metals on the cathode or any combination thereof.

22. The process of claim 21, wherein proteins, gelatin, agar-agar, surfactants or any mixtures thereof are used as the organic additives.

23. The process of claim 21, wherein sulfates, chlorides or nitrates of the alkali metals or soluble chlorides or nitrates of the alkaline-earth metals or any mixtures thereof, are used as the inorganic additives.

24. The process of claim 20, wherein the cathode surface in coated with a thin, electrically nonconducting layer, which fosters the powder detachment behavior of the cathode.

25. The process of claim 20, wherein the powders are intermetallic compounds or noble metal alloy powders.

* * * * *